US008122998B2

(12) United States Patent
Liles

(10) Patent No.: US 8,122,998 B2
(45) Date of Patent: Feb. 28, 2012

(54) DEVICE FOR TRANSPORTING AND ERECTING A HUNTING LADDER STAND

(76) Inventor: Dale L. Liles, Eldon, IA (US)

( * ) Notice: Subject to any disclaimer, the term of this patent is extended or adjusted under 35 U.S.C. 154(b) by 1023 days.

(21) Appl. No.: 12/045,796

(22) Filed: Mar. 11, 2008

(65) Prior Publication Data

US 2009/0229914 A1 Sep. 17, 2009

(51) Int. Cl.
*E06C 7/16* (2006.01)

(52) U.S. Cl. ..... 182/20; 182/21; 182/141; 182/142

(58) Field of Classification Search ..... 182/20, 182/21, 141, 142
See application file for complete search history.

(56) References Cited

U.S. PATENT DOCUMENTS 610,691 A 9/1898 Ryder
2,829,814 A 4/1958 Warner
3,282,375 A * 11/1966 Ray ..... 182/16
(Continued)

*Primary Examiner* — Alvin Chin Shue
*Assistant Examiner* — Colleen M Quinn
(74) *Attorney, Agent, or Firm* — McKee, Voorhees & Sease, P.L.C.

(57) ABSTRACT

A device is provided which can be converted from a transporting cart to an erecting hoist for a hunter's tree ladder stand. The device includes components which can be assembled into the cart, disassembled, and re-assembled into the hoist which allows one person to transport the ladder stand, and to raise and lower the ladder stand to and from a position against a tree. The hoist includes a clamp with jaws which can be operated by the hunter on the ground so as to secure the hoist to the tree. A rope or cable extends through a pulley on the hoist so that the ladder stand can be raised into position by a hunter, single-handily. The hunter can then climb the ladder stand, which is secured to the hoist, which is secured to the tree, and further attach the platform of the ladder stand to the tree with one or more straps.

9 Claims, 8 Drawing Sheets

U.S. PATENT DOCUMENTS

| | | | | | |
|---|---|---|---|---|---|
| 3,568,796 | A | | 3/1971 | Stanhope | |
| 4,134,474 | A | | 1/1979 | Stavenau et al. | |
| 4,493,395 | A | * | 1/1985 | Rittenhouse | 182/187 |
| 4,995,476 | A | * | 2/1991 | Buck | 182/206 |
| 5,064,020 | A | * | 11/1991 | Eagleson | 182/20 |
| 5,195,611 | A | | 3/1993 | Untz | |
| 5,275,257 | A | * | 1/1994 | Robertson | 182/116 |
| 5,282,520 | A | | 2/1994 | Walker | |
| 5,314,042 | A | * | 5/1994 | Adams | 182/187 |
| 5,368,127 | A | * | 11/1994 | Phillips | 182/187 |
| 5,388,664 | A | | 2/1995 | Bator | |
| 5,566,780 | A | | 10/1996 | Bambrough | |
| 5,803,694 | A | | 9/1998 | Steele | |
| 6,186,271 | B1 | * | 2/2001 | Borries et al. | 182/20 |
| 6,505,707 | B1 | * | 1/2003 | Berry | 182/20 |
| 6,516,918 | B2 | * | 2/2003 | Hess | 182/20 |
| 6,516,919 | B1 | * | 2/2003 | Sempel | 182/20 |
| 6,811,180 | B1 | | 11/2004 | Molliere | |
| 6,860,364 | B1 | * | 3/2005 | Deemer | 182/20 |
| 6,991,250 | B2 | * | 1/2006 | Lindsey et al. | 280/651 |
| 7,168,522 | B1 | | 1/2007 | Price | |
| 7,735,605 | B2 | * | 6/2010 | Davis | 182/63.1 |
| 7,909,139 | B2 | * | 3/2011 | Blue et al. | 182/141 |
| 2006/0207831 | A1 | * | 9/2006 | Moore et al. | 182/20 |

* cited by examiner

DEVICE FOR TRANSPORTING AND ERECTING A HUNTING LADDER STAND

BACKGROUND OF THE INVENTION

Ladder stands are commonly used by deer hunters so as to be elevated above the ground to eliminate human odors that deer and other prey can detect at ground level. Ladder stands typically weigh 60-150 pounds, or more, and usually must be transported deep into the woods for setup against a tree. Due to the weight of the stand, a hunter usually has to make multiple trips to transport the stand components from his truck to a desired location in the woods. Then, it normally requires two people to tilt the ladder stand upwardly into position against the tree. Since the platform for the hunter is at the top of the ladder, the bulk of the weight of the stand is at the top. The stand must be secured with a safety strap to the tree, which requires that someone climb the ladder to the platform. If the ladder is unstable, such climbing is risky before the strap is secured. It is not uncommon for a hunter and ladder to fall before the stand is secured, with potential injury to the hunter. If the hunter is alone, the risk of injury is even greater.

Therefore, a primary objective of the present invention is the provision of a device for single-handily transporting and erecting a tree ladder stand by a hunter with safety.

Another objective of the present invention is the provision of a device which can be converted from a cart for hauling a tree stand to a pulley system for erecting the tree stand into position against a tree in the woods.

Still another objective of the present invention is the provision of a device for transporting and raising a tree stand which can be quickly and easily assembled and disassembled.

A further objective of the present invention is the provision of a device for transporting a hunting ladder stand manually or with an ATV.

Yet another objective of the present invention is the provision of a device which quickly and easily clamps to a tree for raising and lowering a hunter's ladder stand.

Another objective of the present invention is the provision of a device for transporting and positioning a tree ladder stand which is economical to manufacture, and durable and safe in use.

These and other objectives will become apparent from the following description of the invention.

BRIEF SUMMARY OF THE INVENTION

The present invention is directed towards a device which can be used to transport and erect a tree ladder stand by the hunter alone. The device comprises a cart for hauling the stand, with the cart being converted into a hoist assembly which clamps to the tree for raising and lowering the stand. The cart includes a handle assembly and a wheeled axle assembly, with a plurality of poles forming the bed of the cart. The poles can be disassembled from the cart, and re-assembled end to end, with a clamp attached to the top of the poles so as to form the stand hoist assembly. A first pulley system actuates the clamp for attachment to the tree by the hunter on the ground. A second pulley system on the clamp controls a rope or cable attached to the top of the ladder stand for raising and lowering the stand, without assistance from a second person.

DETAILED DESCRIPTION OF THE PREFERRED EMBODIMENT

Figure 1:
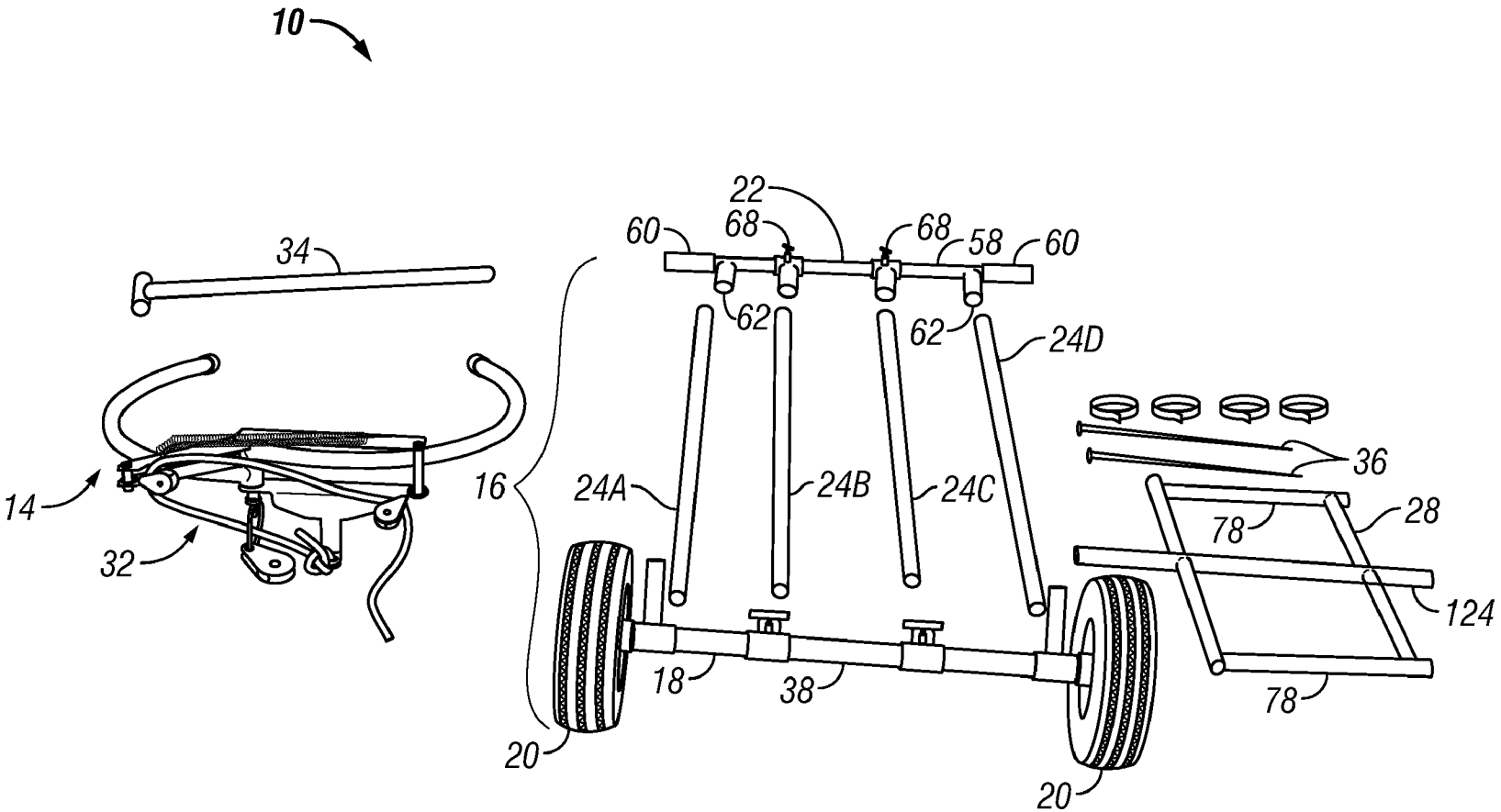
FIG. 1 is a view showing the disassembled components of the device of the present invention for transporting and erecting a hunter's tree ladder stand.

The device 10 of the present invention is shown in a disassembled state in FIG. 1. The device 10 includes multiple components which can be quickly and easily assembled and disassembled into a cart 12 (FIG. 2), a hoist assembly 14 (FIG. 4), and a pivotal base assembly 16 (FIG. 5). The components of the device 10 include an axle assembly 18 with wheels 20, a handle assembly 22, and plurality of poles 24A, B, C, D which form the bed 26 of the cart, and a rectangular frame 28 which forms the rear wall 30 of the cart 12. The components of the device 10 further include a clamp assembly 32, a T-bar 34, and a pair of stakes 36. The T-bar 34 may be telescoping for adjustable length.

Figure 9:
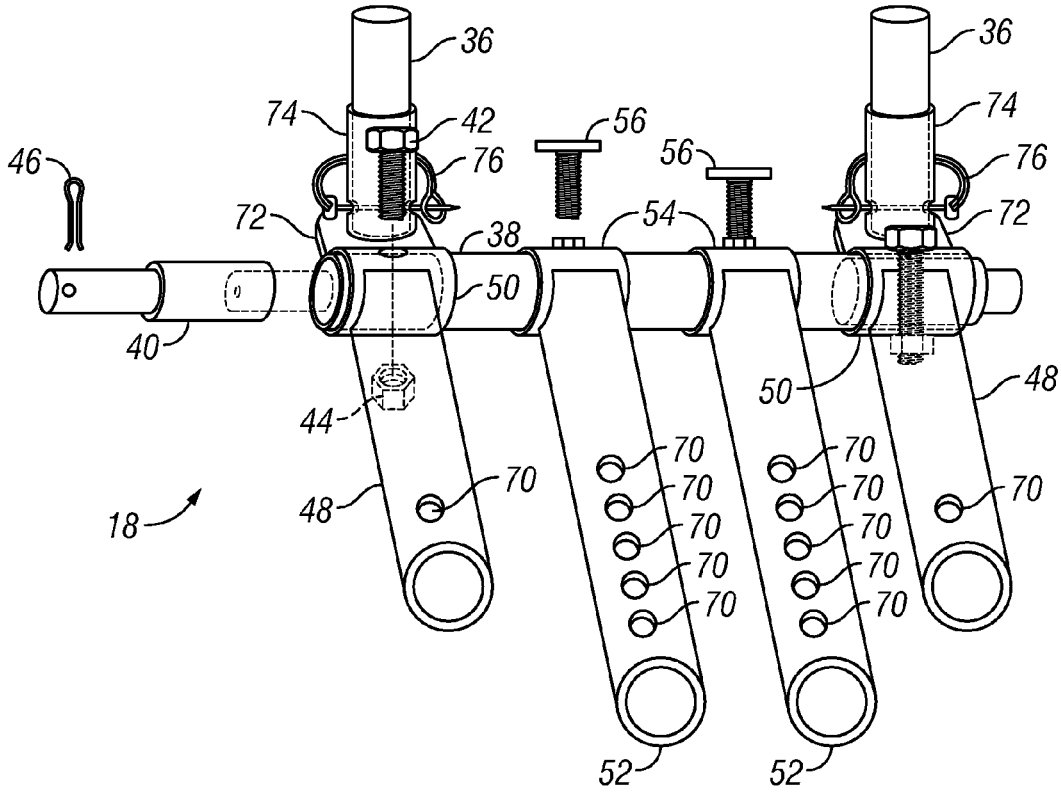
FIG. 9 is a partially exploded view of the axle portion of the device.
Figure 10:
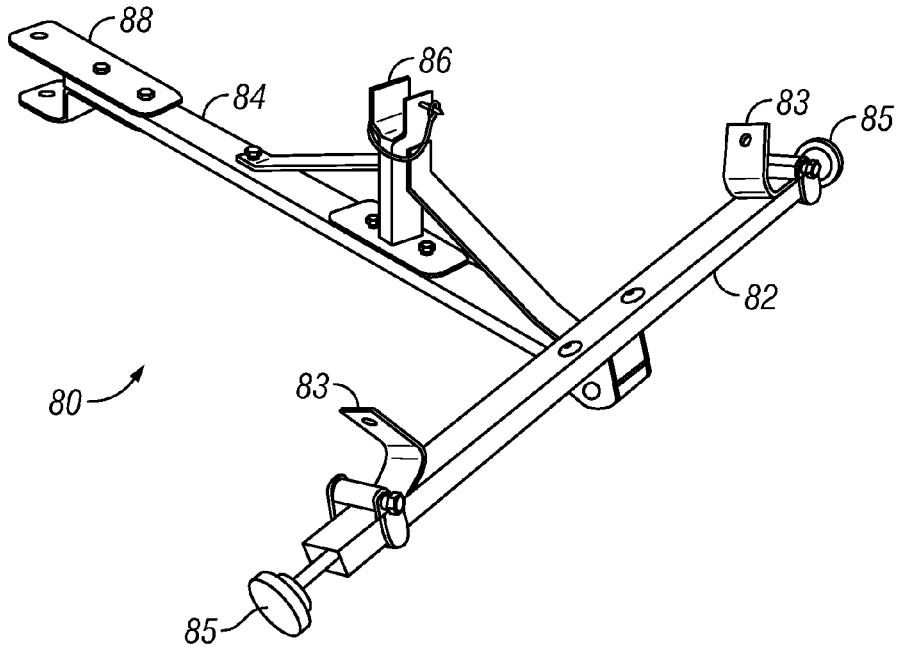
FIG. 10 is a perspective view of the hitch assembly of the present invention.

The axle assembly 18 is best shown in FIG. 9, and it includes a cross bar 38 with a spindle 40 inserted in each end of the cross bar 38 and secured thereto with a bolt 42 and nut 44. The wheels 20 are rotatably mounted on the ends of the spindles 40 and retained by a pin 46. A pair of outer tubular shafts 48 extend forwardly from the cross bar 38 via mounting collars 50 which are attached to the cross bar 38 via the bolts 42. A pair of inner tubular shafts are mounted on the cross bar 38 via collars 54, and are secured through the cross bar 38 via T-bolts 56, such that the spacing of the shafts 52 can be selectively adjusted.

The handle assembly 22 also includes a cross bar 58 with hand grips 60 on the outer ends thereof. Outer tubular shafts 62 are bolted or otherwise secured to the cross bar 58, while inner tubular shafts 64 are adjustably mounted on the cross bar 58 via collars 66 and T-bolts 68.

Figure 2:
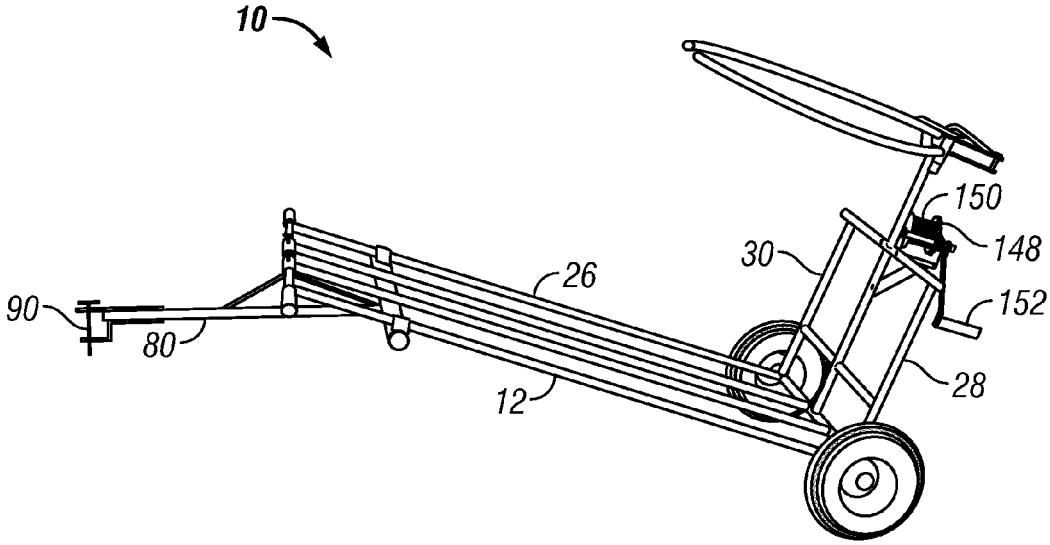
FIG. 2 is a view of the device assembled as a cart for transporting the tree stand.

The poles 24 are releasably mounted on the free ends of the shafts 48, 52 of the axle assembly 18 and shafts 62, 64 of the handle assembly 22, so as to form the bed 26 of the cart 12, as best seen in FIG. 2. In the preferred embodiment, the poles 24 include a spring-biased detent, such as a valco button, on each end for receipt in holes 70 in the free ends of the shafts 48 uses a latch pin, nothing secures 52, 62, and 64. Thus, the poles 24 can be quickly and easily connected and disconnected to the actual axle 18 and handle assembly 22 without the use of tools.

As seen in FIG. 9, the axle assembly 18 has a pair of outer plates 72 extending rearwardly from the cross bar 38, with a pair of tubular shafts 74 mounted to the plates 72 and extending upwardly, approximately perpendicular to the shafts 48, 52, 62, 64. The stakes 36 each have a lower end which is received in the shafts 74 and secured thereto by pins or clips 76. The outer legs 78 of the rectangular frame 28 are hollow for receipt on the upper ends of the stakes 36, so as to form the back wall 30 of the cart 12.

An optional hitch assembly 80 may be mounted to the front end of the cart 12 adjacent the handle assembly 22. The hitch assembly 80 includes a cross arm 82 adapted to be releasably connected to the outer poles 24, and a tongue 84 extending forwardly from the cross arm 82. A saddle 86 mounted to the tongue 84 is pinned to the cross bar 58 of the handle assembly 22, thereby creating a three point connection for the hitch assembly 80 onto the cart 12. The forward end of the tongue 84 includes a yoke 88 with a hitch pin 90 for hitching the cart 12 to the frame of an all terrain vehicle (ATV) or other motorized vehicle. Thus, the hitch assembly 80 allows the cart 12 to be towed rather than manually pushed or pulled. The hitch assembly 80 is not connected to the inner poles 24B, C, such that these poles remain free to adjust laterally, if desired, on the axle assembly 18 and handle assembly 22.

The cross bar 82 of the hitch assembly 80 includes U-shaped locks 83 which pivot between open and closed positions. The locks are secured in the closed position by over-sized headed bolts 85 extending through a hole in the locks 83 and into a nut on the end of each cross arm 82. The bolts 85 can be easily turned by hand, such that the hitch assembly 80 is quickly and easily mounted to the cart 12 without the use of tools.

Figure 4:
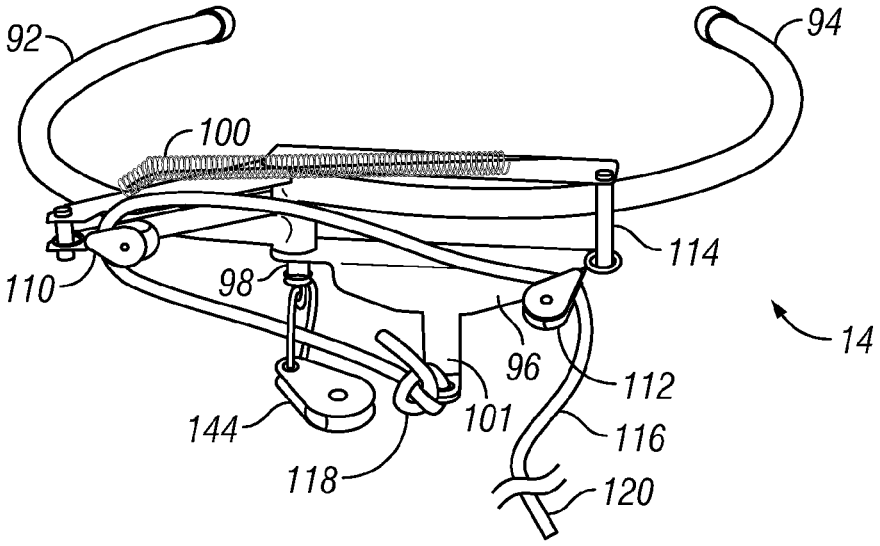
FIG. 4 shows the clamp assembly of the device.
Figure 5:
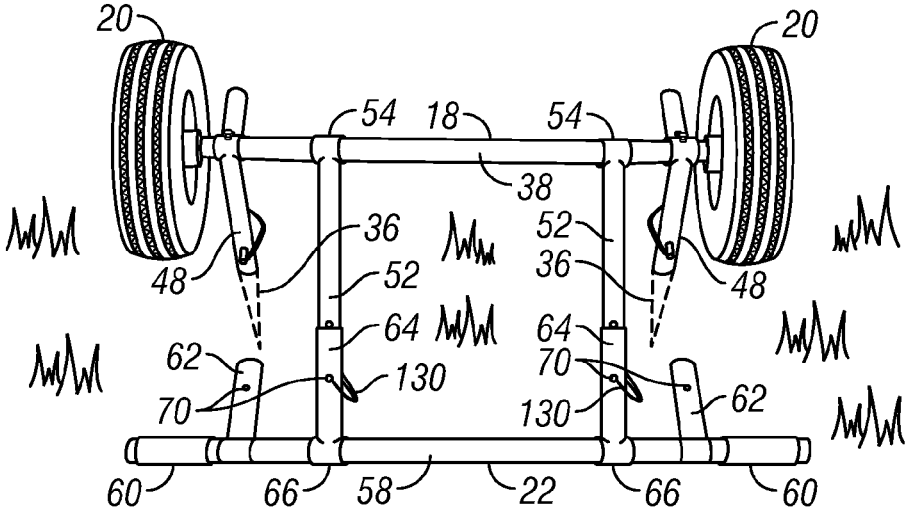
FIG. 5 show the device wherein the cart has been disassembled and partially re-assembled for raising and lowering the tree stand.
Figure 4A:
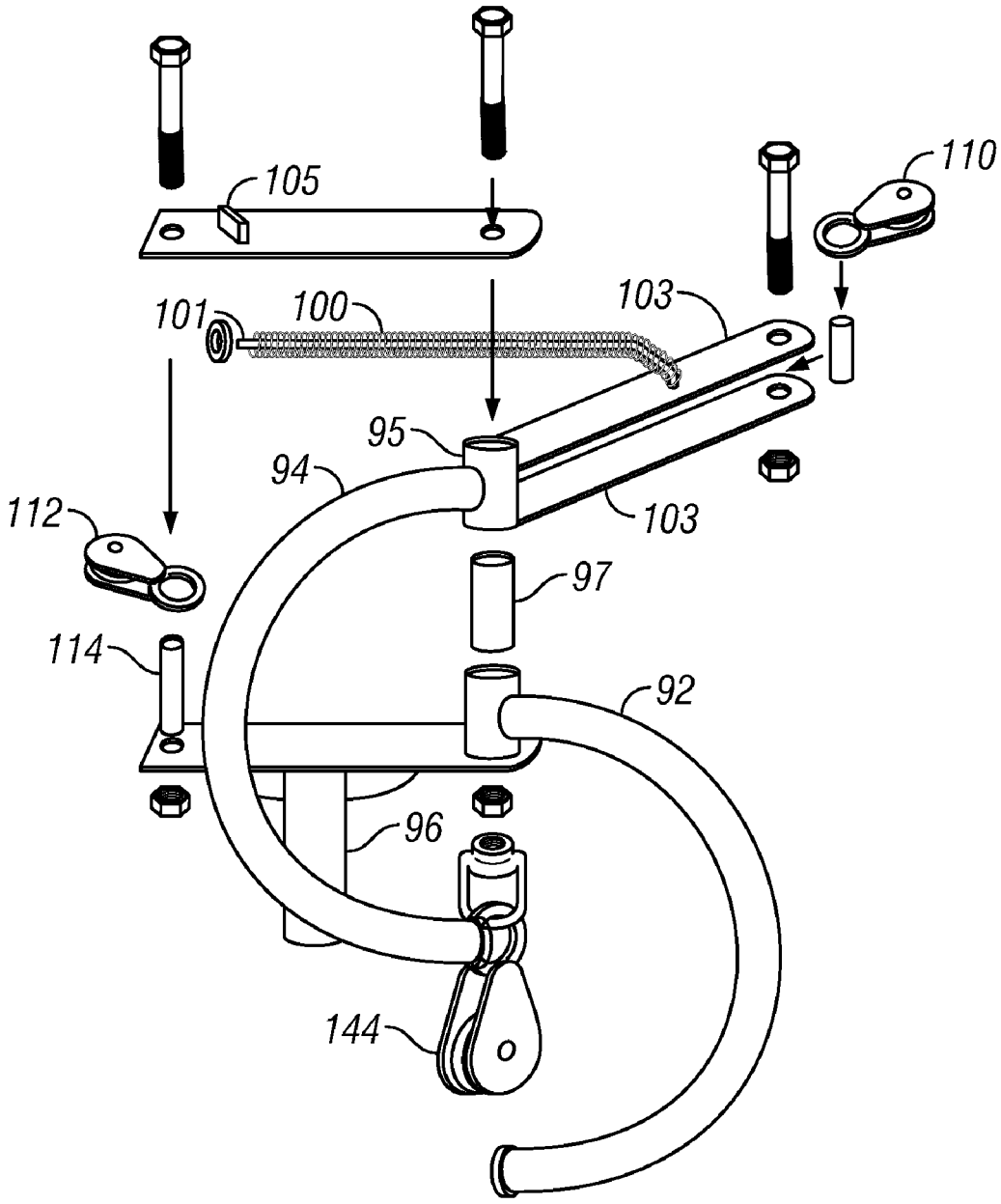
FIG. 4A is an exploded view of the clamp assembly.

The clamp assembly 32 is best seen in FIGS. 4 and 4A, and generally includes a pair of jaws 92, 94 mounted upon a frame 96. The first jaw 92 is fixed relative to the frame 96, while the second jaw 94 is pivotally mounted to the frame 96 via a pivot axis 98. The jaw 94 includes a hub 95 pivotally mounted on an axle 97 defining the pivot axis 98. The jaw 94 is moveable between open and closed positions, but is biased to the open position by a spring 100 mounted on a rod 101 fixed at one end to a leg 103 on the jaw 94 and retained at the opposite end by a bracket 105 on the frame 96. When the jaw 94 is closed, the spring 100 is compressed. A pulley system controls the movement of the jaw 94 between the open and closed positions. More particularly, a first pulley 110 is mounted to the legs 103 of jaw 94, while a second pulley 112 is mounted to an extension 114 of the jaw 92. A rope 116 is threaded through the pulleys 110, 112, and has a first end 118 tied or secured to the frame 96, and a free end 120 which extends downwardly to the hunter on the ground who can pull on the rope 116 to pivot the jaw 94 inwardly and thereby close the clamp assembly 32 around the tree.

The frame 96 of the clamp assembly 32 includes a downwardly extending post for mounting the clamp assembly 32 onto the center post 124 of the rectangular frame 28 on the cart 12, as seen in FIG. 2.

The hoist assembly 14 includes an elongated leg 122 which is formed by the poles 24, the rectangular frame 28, and the T-bar 34. More particularly, the poles 24 have one end with a larger diameter than the opposite end, such that the poles 24 can be attached end to end. The rectangular frame 28 also has center poles 124 which mounts to the lower most pole 24A. The lower end of the center pole 124 of the rectangular frame 28 receives the upper end of the T-bar 34, with the lower end of the bar 34 engaging the ground adjacent the tree. The T-leg on the lower end of the bar 34 prevents the leg 122 of the clamp assembly 32 from digging into the ground, and provides some stability for the hoist assembly 14 and the clamp assembly 32. The pole 24A also includes a cleat 126 around which the free end 120 of the rope 116 can be tied so as to maintain the jaw 94 in the closed position around the tree. The rectangular frame 28 minimizes twisting of the clamp assembly 32 on the tree. A strap 128 may be secured to the rectangular frame 28 or to the pole 24A and around the tree to secure the lower end of the hoist assembly 14 to the tree. Thus, the clamp assembly 32 and the leg 122 form the hoist assembly 14 for raising and lowering the ladder stand, as described above.

The hoist assembly 14 also includes a reconfigured portion of the cart 12. As seen in FIG. 5, the handle assembly 22 is mounted onto the axle assembly 18 by extending the inner shafts 52 of the axle assembly 18 into the inner shafts 64 of the handle assembly, and securing the connected shafts with clips 130. The T-bolts 56 of the inner shafts 52 are loosened so that the inner shafts 52 can be rotated around the cross bar 38 of the axle assembly 18 so as to extend in a direction substantially opposite of the outer shafts 48, as seen in FIG. 5.

The hunter's ladder stand 132 includes a ladder 134 formed by one or more ladder sections, and a platform 136. The platform 136 includes a seat 138 and a rail 140. The ladder stand 132 is conventional in construction and does not constitute part of the present invention.

Figure 3:
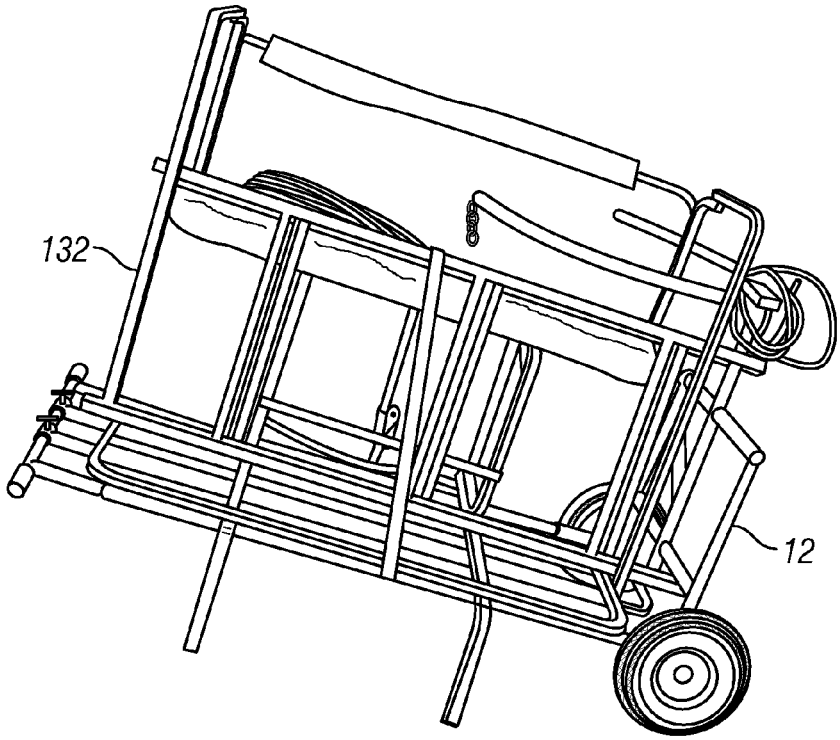
FIG. 3 shows the cart with a tree stand mounted thereon.
Figure 6:
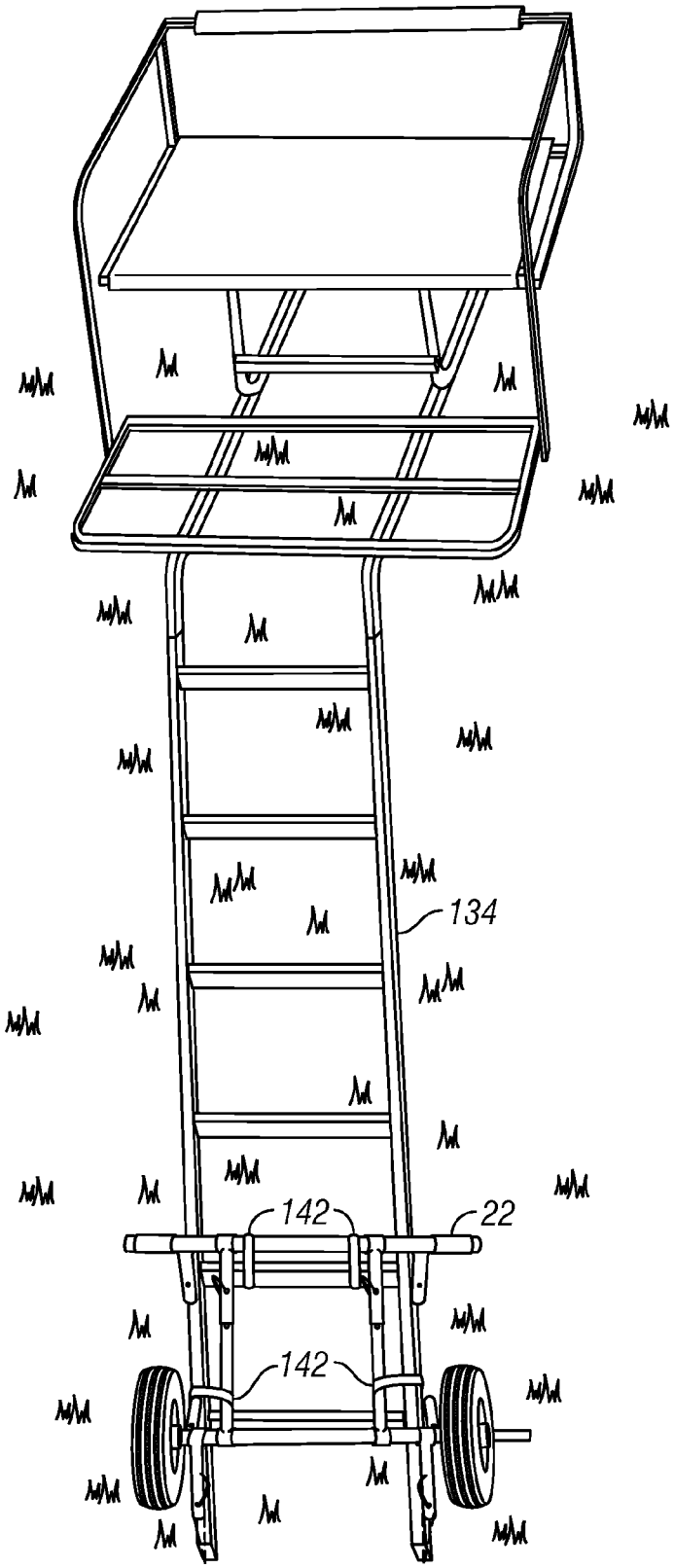
FIG. 6 is a view showing the ladder of the tree stand strapped to the re-assembled frame with the ladder stand on the ground in a position ready to be raised.
Figure 7:
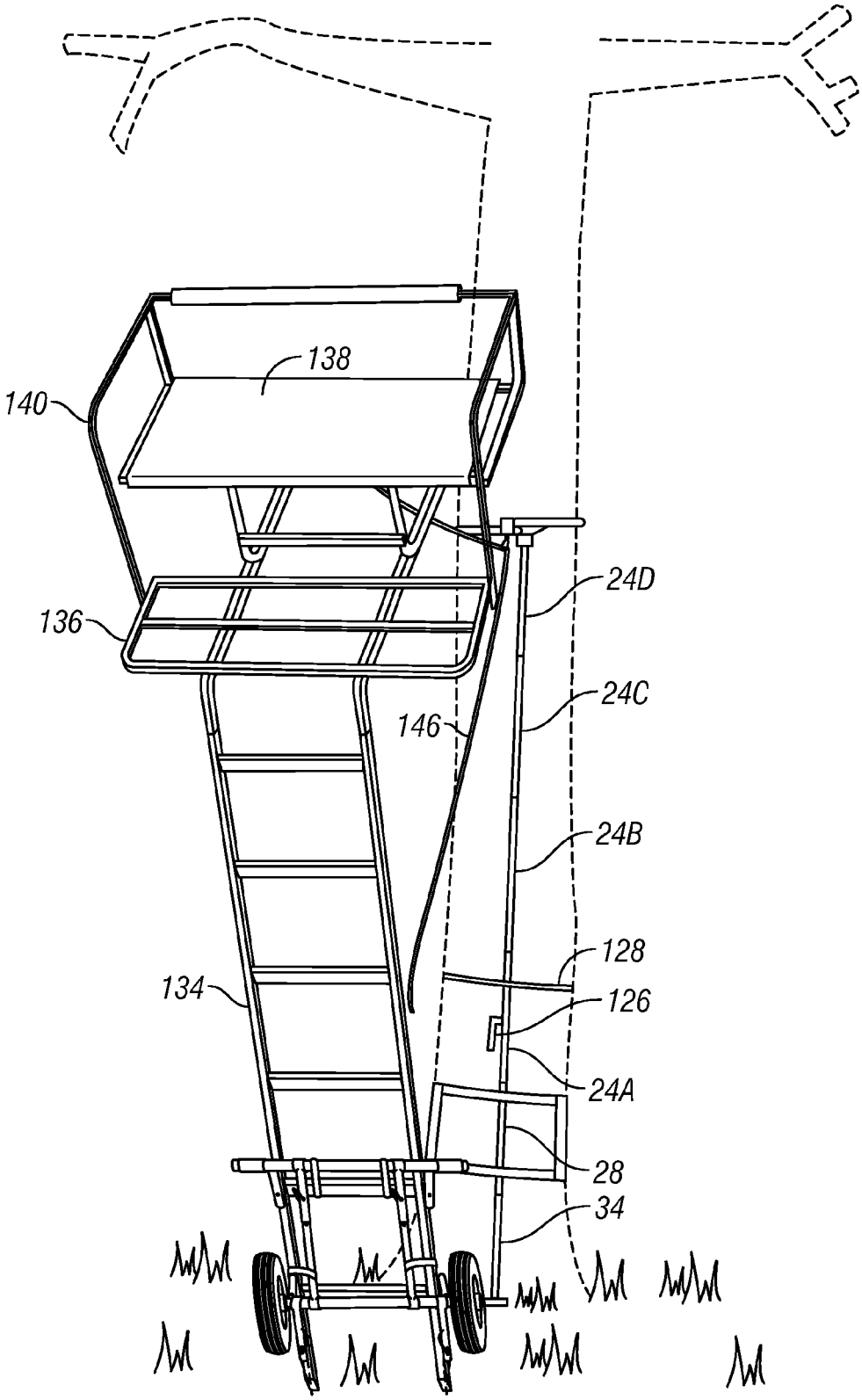
FIG. 7 is a view showing the tree stand in a partially raised position.
Figure 8:
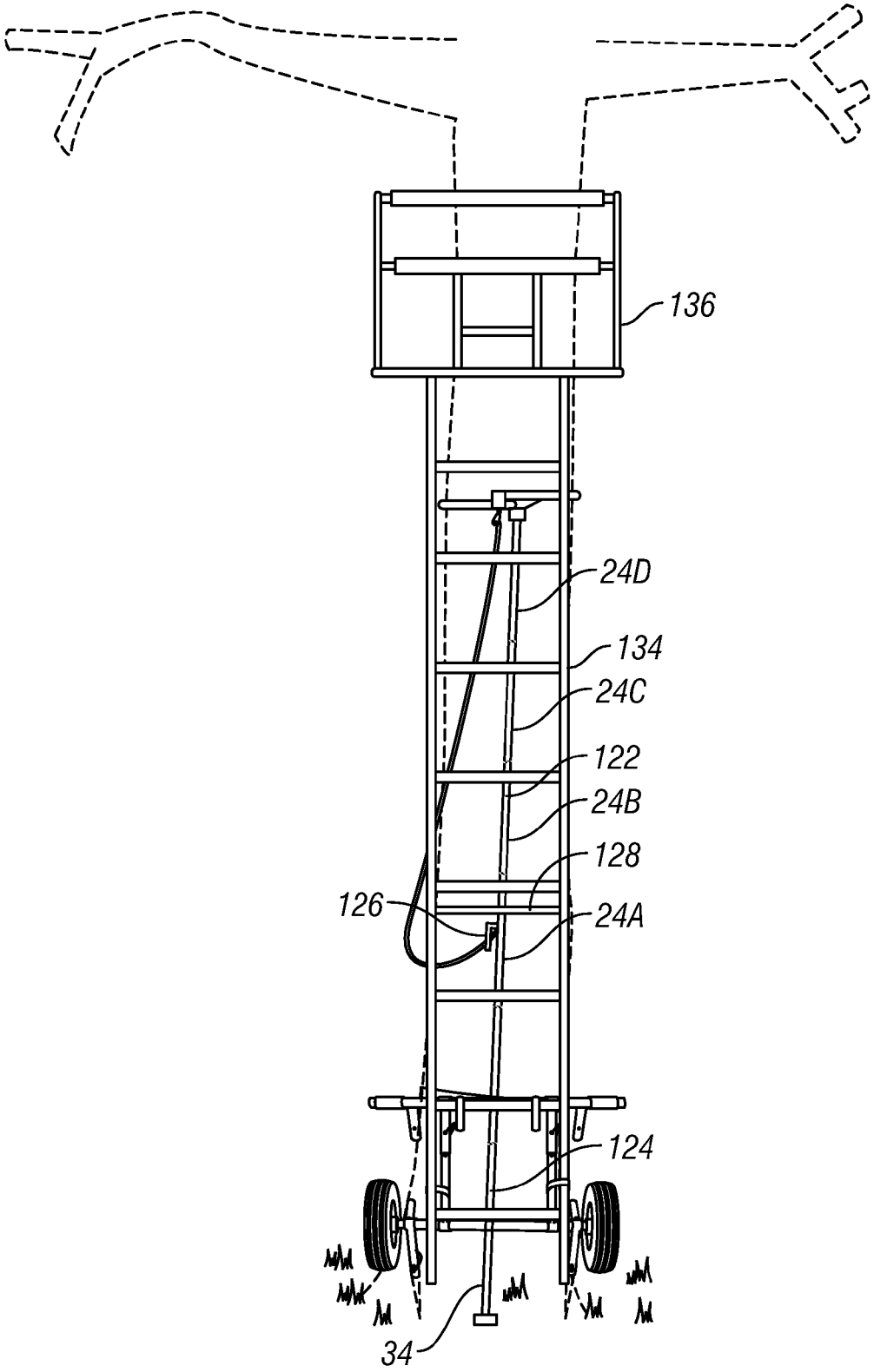
FIG. 8 is a view showing the tree stand in a fully raised position against the tree.

The ladder stand 132 may be partially disassembled for mounting on the cart 12, as best seen in FIG. 3. One or more straps 142 are used to secure the ladder stand 132 to the cart 12. The cart 12 can then be pulled by an ATV or manually pushed or pulled into the woods to a desired tree. The ladder stand 132 is removed from the cart 12 and assembled. The base assembly 16 of the device 10 is positioned adjacent the tree and the stakes 36 forced into the ground in any convenient manner. The handle assembly 22 rests upon the ground, and the ladder sections 134 are secured by straps 142 to the axle assembly 18 and handle assembly 22, as best seen in FIG. 6. The T-bolts 56 are not tightened, such that the handle assembly 22 is free to pivot upwardly.

A third pulley 144 is mounted on the frame 96 of the clamp assembly 32. A second rope 146 is threaded through the pulley 144 (before the hoist assembly 14 is raised into position against the tree), with one end of the rope being connected to the platform 136 of the ladder stand 132. The free end of the rope 146 can be pulled by the hunter on the ground so as to raise the ladder stand 132 single-handily into position against the tree. The free end of the rope 146 can then be tied around the cleat 126 on pole 24A so as to temporarily secure the ladder stand 132 in an upright position against the tree. The hunter can then climb the ladder stand 132 and use additional straps to tie the platform 136 to the tree in a conventional manner, without the risk of the ladder stand 132 tipping or falling.

As an alternative to manually raising the ladder stand 132 using the rope 146, an optional winch 148 with a cable 150 can be mounted on the rectangular frame 28, as best seen in FIG. 2. One end of the cable 150 is secured to the winch 148, with the cable extending through the pulley 144, and the free end of the cable attached to the platform 136 of the ladder stand 132. Then, the winch crank 152 can be turned by the hunter so as to raise the ladder stand 132 into position against the tree. The winch 148 may include reduction gears so that even a heavy ladder stand 132 can be raised by a small hunter, without assistance from another person.

When a hunter desires to remove the ladder stand 132 from the tree, the procedure is reversed, using either the rope 146 or the winch 148.

It is understood that the cart 12 can also be used for transporting a deer or other animal shot by the hunter out of the woods.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A device for transporting and erecting a tree ladder stand for hunting, comprising:

a cart having:

an axle assembly with wheels;

a handle assembly;

a plurality of poles each having opposite ends removable assembled to axle and handle assemblies to form a bed of the cart;

a wall removably assembled to the axle assembly;

a tree ladder stand placeable onto the cart for transport to a tree;

a hoist assembly having:

a leg having top and bottom ends formed by the poles being disassembled from the axle and handle assemblies and re-assembled end-to-end;

a clamp mounted on the top end of the leg;

a first pulley system on the clamp;

a rope operatively threaded through the first pulley system and having a first end connected to the clamp, and a second end to be pulled by a hunter on the ground to close the clamp around the tree;

a second pulley system on the clamp;

a line threaded through the second pulley system and having a first end connected to the tree stand and a second end to be pulled and thereby raise the ladder stand into position against the tree without assistance from another person.

2. The device of claim 1 further comprising a pair of stakes mounted to the axle assembly, and the cart wall being removably mounted on the stakes.

3. The device of claim 2 wherein the axle and handle assemblies are joined after the poles are disassembled from the cart, and the ladder stand is secured to the handle assembly, and wherein the stakes are adapted to be forced into the ground adjacent the tree after the wall is removed, with the ladder stand operatively secured to the handle assembly for rotation therewith about the axle assembly when the line is pulled to raise the stand.

4. The device of claim 1 wherein the clamp includes first and second jaws moveable between open and closed positions.

5. The device of claim 4 wherein the jaws are spring-biased towards the open position.

6. The device of claim 4 wherein the jaws are curved to extend around the tree.

7. The device of claim 4 further comprising a winch on the leg to pull the line to raise the ladder stand.

8. The device of claim 1 further comprising a tongue on the cart adapted for connection to a hitch on a vehicle.

9. The device of claim 1 further comprising a T-member on the bottom end of the leg for stabilization.

* * * * *